US012253327B2

(12) United States Patent
Hedeen et al.

(10) Patent No.: US 12,253,327 B2
(45) **Date of Patent: *Mar. 18, 2025**

(54) FIREARM INCLUDING ELECTRONIC COMPONENTS TO ENHANCE USER EXPERIENCE

(71) Applicant: Laser Aiming Systems Corporation, Maple Plain, MN (US)

(72) Inventors: Brian Hedeen, Orono, MN (US); Mike Cisewski, Hutchinson, MN (US); Ethan Mork, Young America, MN (US)

(73) Assignee: Laser Aiming Systems Corporation, Maple Plain, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/101,002

(22) Filed: Jan. 24, 2023

(65) Prior Publication Data

US 2023/0384047 A1 Nov. 30, 2023

Related U.S. Application Data

(63) Continuation of application No. 17/217,828, filed on Mar. 30, 2021, now Pat. No. 11,561,057, which is a (Continued)

(51) Int. Cl.
*F41A 9/62* (2006.01)
*F41A 19/01* (2006.01)
(Continued)

(52) U.S. Cl.
CPC ..... *F41A 9/62* (2013.01); *F41A 19/01* (2013.01); *F41C 23/10* (2013.01); *F41G 1/35* (2013.01)

(58) Field of Classification Search
CPC .. F41A 9/62; F41A 19/01; F41C 23/10; F41G 1/35
See application file for complete search history.

(56) References Cited

U.S. PATENT DOCUMENTS 2,303,479 A 12/1942 Lesnick
5,005,307 A 4/1991 Horne et al.
(Continued)

FOREIGN PATENT DOCUMENTS

CA 2452538 C 6/2008
CA 2592225 C 8/2011
(Continued)

OTHER PUBLICATIONS ammoland.com [online], "Magcount Because You Gotta Know" MagCount Ammunition Counting Technology Demonstration, published on Oct. 13, 2010, retrieved from URL <https://www.ammoland.com/2010/10/magcount-because-you-gotta-know>, 4 pages.
(Continued)

*Primary Examiner* — J. Woodrow Eldred
(74) *Attorney, Agent, or Firm* — Christensen, Fonder, Dardi & Herbert PLLC; Timothy J. Busse

(57) ABSTRACT

A firearm includes a barrel portion, a slide, and a frame. The frame includes a grip, and the grip includes a magazine chamber and a rear surface adjacent the slide. At least one sensor is carried by the grip, and the at least one sensor adapted to sense a state of the magazine detachably received in the magazine chamber corresponding to a number of cartridges of ammunition remaining in the magazine. A display is carried on the rear surface of the grip, and the display includes a plurality of illuminating devices. The display is operatively coupled to the at least one sensor and is operable to visually present the number of cartridges of ammunition remaining in the magazine by illuminating at least one of the plurality of illuminating devices.

6 Claims, 6 Drawing Sheets

Related U.S. Application Data continuation of application No. 15/951,591, filed on Apr. 12, 2018, now Pat. No. 10,962,314.

(60) Provisional application No. 62/484,471, filed on Apr. 12, 2017.

(51) Int. Cl.
*F41C 23/10* (2006.01)
*F41G 1/35* (2006.01)

(56) References Cited

U.S. PATENT DOCUMENTS 5,052,138 A 10/1991 Crain
5,142,805 A 9/1992 Horne et al.
5,303,495 A 4/1994 Harthcock
5,307,053 A 4/1994 Wills et al.
5,406,730 A 4/1995 Sayre
5,425,299 A 6/1995 Teetzel
5,566,486 A 10/1996 Brinkley
5,584,137 A 12/1996 Teetzel
5,642,581 A 7/1997 Herold et al.
5,735,070 A 4/1998 Vasquez et al.
5,755,056 A 5/1998 Danner et al.
5,799,432 A 9/1998 Wright, Sr. et al.
5,826,360 A 10/1998 Herold et al.
5,918,304 A 6/1999 Gartz
6,062,208 A 5/2000 Seefeldt et al.
6,094,850 A 8/2000 Villani
6,321,478 B1 11/2001 Klebes
6,360,468 B1 3/2002 Constant et al.
6,397,508 B1 6/2002 Constant et al.
6,421,944 B1 7/2002 Klebes et al.
6,493,977 B1 12/2002 Liebenberg et al.
6,539,661 B2 4/2003 Hope
6,615,531 B1 9/2003 Holmberg
6,643,968 B2 11/2003 Glock
6,779,518 B2 8/2004 Dobbins
6,785,996 B2 9/2004 Danner et al.
6,802,147 B2 10/2004 Haefeli et al.
6,860,259 B2 3/2005 Rice et al.
6,898,890 B2 5/2005 Gaber
6,935,864 B2 8/2005 Shechter et al.
6,941,693 B2 9/2005 Rice et al.
6,952,881 B2 10/2005 McGivern
7,032,342 B2 4/2006 Pikielny
7,143,644 B2 12/2006 Johnson et al.
7,158,167 B1 1/2007 Yerazunis et al.
7,185,646 B2 3/2007 Jones
7,234,260 B2 6/2007 Acarreta
7,356,956 B2 4/2008 Schinazi et al.
7,509,766 B2 3/2009 Vasquez
7,661,217 B2 2/2010 Pikielny
7,669,356 B2 3/2010 Joannes et al.
7,716,863 B1 5/2010 Johnson et al.
7,730,654 B2 6/2010 Kim
7,797,873 B2 9/2010 Gering et al.
7,802,391 B2 9/2010 Quinn et al.
7,810,273 B2 10/2010 Koch et al.
7,926,219 B2 4/2011 Reimer
7,927,102 B2 4/2011 Jones et al.
8,009,060 B2 8/2011 Kramer et al.
8,019,278 B2 9/2011 Baraz et al.
8,046,946 B2 11/2011 Packer et al.
8,117,778 B2 2/2012 Clark et al.
8,118,016 B2 2/2012 Italia et al.
8,132,496 B2 3/2012 Zukowski
8,166,698 B2 5/2012 Raviv et al.
8,176,667 B2 5/2012 Kamal et al.
8,186,086 B2 5/2012 Gur-Ari et al.
8,191,297 B2 6/2012 Gwillim, Jr.
8,196,331 B2 6/2012 Chen et al.
8,215,044 B2 6/2012 Arbouw
8,223,019 B2 7/2012 August et al.
8,339,257 B2 12/2012 Cazanas et al.
D676,919 S 2/2013 Delgado Acarreta
D677,178 S 3/2013 Delgado Acarreta
8,387,295 B2 3/2013 Glock
8,397,705 B2 3/2013 DeHaan et al.
8,418,388 B2 4/2013 Ferrarini et al.
D684,234 S 6/2013 Delgado Acarreta
D684,646 S 6/2013 Delgado Acarreta
D684,650 S 6/2013 Delgado Acarreta
D684,651 S 6/2013 Delgado Acarreta
D684,652 S 6/2013 Delgado Acarreta
8,459,552 B2 6/2013 Arbouw
8,464,451 B2 6/2013 McRae
8,464,452 B2 6/2013 Harper
8,474,172 B2 7/2013 Ivtsenkov et al.
8,485,085 B2 7/2013 Goree et al.
D690,788 S 10/2013 Acarreta
8,571,815 B2 10/2013 Bar-David et al.
D693,421 S 11/2013 Acarreta
8,578,920 B2 11/2013 Estrate
8,601,733 B2 12/2013 Gabay et al.
8,651,381 B2 2/2014 Rudich
8,656,820 B1 2/2014 Kertis, Jr. et al.
8,683,733 B2 4/2014 Gross et al.
8,713,844 B2 5/2014 Tuller, Jr. et al.
8,720,092 B2 5/2014 Gussalli Beretta et al.
8,733,006 B2 5/2014 Williams et al.
8,733,007 B2 5/2014 Hatfield
8,738,330 B1 5/2014 DiMartino et al.
D708,290 S 7/2014 Acarreta
8,770,978 B2 7/2014 Botten
D713,486 S 9/2014 Acarreta
8,826,575 B2 9/2014 Ufer et al.
8,827,706 B2 9/2014 Hogan, Jr.
8,850,730 B2 10/2014 Clark et al.
8,857,091 B2 10/2014 Delgado Acarreta
8,875,433 B2 11/2014 Beckman
8,936,193 B2 1/2015 McHale et al.
8,959,824 B2 2/2015 Sammut et al.
8,973,294 B2 3/2015 Delgado Acarreta
8,978,539 B2 3/2015 Teetzel et al.
9,057,571 B2 6/2015 Kemmerer et al.
9,057,584 B2 6/2015 Chung
9,068,785 B2 6/2015 Ball
9,114,312 B2 8/2015 Liao
D745,625 S 12/2015 Acarreta et al.
9,212,857 B2 12/2015 Loreman
9,217,616 B2 12/2015 Sullivan et al.
D747,757 S 1/2016 Daniel
9,273,918 B2 3/2016 Amit et al.
9,303,937 B2 4/2016 Acarreta
9,310,163 B2 4/2016 Bay
9,316,461 B1 4/2016 Gwillim, Jr.
D757,206 S 5/2016 Delgado Acarreta et al.
9,341,424 B2 5/2016 Allan
9,435,594 B2 9/2016 Davison et al.
9,557,130 B2 1/2017 Shneorson et al.
9,612,068 B2 4/2017 Burden
9,677,852 B2 6/2017 Tikochinski et al.
9,759,505 B2 9/2017 Al Abdouli et al.
9,784,511 B2 10/2017 Faughn
9,797,667 B2 10/2017 Demierre et al.
9,811,079 B2 11/2017 Theiss
9,835,395 B2 12/2017 Ruby et al.
D815,239 S 4/2018 Cheng et al.
10,323,894 B2 6/2019 Imbriano et al.
10,359,246 B2 7/2019 Faughn
10,459,678 B2 10/2019 Samo
10,466,012 B2 11/2019 Uhr
10,557,676 B2 2/2020 Masarik et al.
10,591,250 B2 3/2020 Mock et al.
10,962,314 B2 * 3/2021 Hedeen ..... F41A 9/62
11,561,057 B2 * 1/2023 Hedeen ..... F41C 23/10
2002/0129535 A1 9/2002 Osborn, II
2003/0195046 A1 10/2003 Bartsch
2006/0042142 A1 3/2006 Sinha
2006/0162226 A1 7/2006 Tai
2007/0000483 A1 1/2007 Tsurumoto
2008/0028660 A1 2/2008 Gussalli Beretta
2008/0127538 A1 6/2008 Barrett et al.

(56) References Cited

U.S. PATENT DOCUMENTS

| | | | |
|---|---|---|---|
| 2008/0131848 | A1 | 6/2008 | Wilson et al. |
| 2009/0084015 | A1 | 4/2009 | Compton et al. |
| 2010/0031808 | A1 | 2/2010 | Whitlow et al. |
| 2010/0299985 | A1 | 12/2010 | Delgado Acarreta |
| 2011/0078936 | A1 | 4/2011 | Gates |
| 2011/0111374 | A1 | 5/2011 | Charles |
| 2011/0113664 | A1 | 5/2011 | Delgado Acarreta |
| 2011/0252682 | A1 | 10/2011 | Delgado Acarreta |
| 2012/0042559 | A1 | 2/2012 | Bockmon |
| 2012/0152103 | A1 | 6/2012 | Testa et al. |
| 2012/0159833 | A1 | 6/2012 | Hakanson et al. |
| 2012/0167423 | A1 | 7/2012 | Kindt et al. |
| 2013/0108991 | A1 | 5/2013 | Walls |
| 2013/0125438 | A1 | 5/2013 | Delgado Acarreta |
| 2013/0152447 | A1 | 6/2013 | Östergren et al. |
| 2013/0180143 | A1 | 7/2013 | Delgado Acarreta |
| 2013/0219762 | A1 | 8/2013 | Delgado Acarreta |
| 2013/0263491 | A1 | 10/2013 | Jung et al. |
| 2013/0337416 | A1 | 12/2013 | Guissin |
| 2014/0150316 | A1 | 6/2014 | Acarreta |
| 2014/0184788 | A1 | 7/2014 | McHale et al. |
| 2014/0378088 | A1 | 12/2014 | Goel et al. |
| 2015/0059225 | A1 | 3/2015 | Huang |
| 2015/0075047 | A1 | 3/2015 | August et al. |
| 2015/0369553 | A1 | 12/2015 | Stussak |
| 2015/0377572 | A1 | 12/2015 | Darragjati |
| 2016/0033221 | A1 | 2/2016 | Schmehl et al. |
| 2016/0069629 | A1 | 3/2016 | Seckman |
| 2016/0069640 | A1 | 3/2016 | Pretorius |
| 2016/0169608 | A1 | 6/2016 | Schulz et al. |
| 2016/0305740 | A1 | 10/2016 | O'Donnell et al. |
| 2016/0327365 | A1 | 11/2016 | Collin et al. |
| 2016/0334177 | A1 | 11/2016 | Green |
| 2016/0349005 | A1 | 12/2016 | Gale et al. |
| 2017/0176139 | A1 | 6/2017 | Zhang et al. |
| 2017/0227310 | A1 | 8/2017 | Gorza et al. |
| 2017/0336160 | A1 | 11/2017 | Walther et al. |
| 2018/0299217 | A1 | 10/2018 | Hedeen et al. |
| 2019/0208092 | A1 | 7/2019 | Patton |
| 2021/0010769 | A1 | 1/2021 | Czarnecki et al. |
| 2021/0310759 | A1 | 10/2021 | Hedeen et al. |

FOREIGN PATENT DOCUMENTS

| | | | |
|---|---|---|---|
| CA | 2591001 | C | 9/2011 |
| CN | 101126615 | A | 2/2008 |
| DE | 3911804 | A1 | 10/1990 |
| DE | 4022038 | A1 | 1/1992 |
| DE | 4022038 | C2 | 3/1999 |
| DE | 102010054245 | A1 | 6/2012 |
| EP | 1514070 | B1 | 4/2014 |
| EP | 1646837 | B1 | 8/2014 |
| GB | 2182424 | A | 5/1987 |
| GB | 2397128 | A | 7/2004 |
| JP | H04298615 | A | 10/1992 |
| JP | H1089894 | A | 4/1998 |
| JP | 2002277193 | A | 9/2002 |
| JP | 2008064406 | A | 3/2008 |
| JP | 2008175526 | A | 7/2008 |
| JP | 4298615 | B2 | 7/2009 |
| JP | 4395357 | B2 | 1/2010 |
| JP | 4594334 | B2 | 10/2010 |
| JP | 4923749 | B2 | 4/2012 |
| JP | 4923750 | B2 | 4/2012 |
| JP | 4996963 | B2 | 8/2012 |
| JP | 2012215373 | A | 11/2012 |
| JP | 2013130373 | A | 7/2013 |
| KR | 100914270 | B1 | 5/2009 |
| KR | 20110035058 | A | 4/2011 |
| KR | 20140046853 | A | 4/2014 |
| RU | 2360208 | C2 | 1/2009 |
| WO | WO2009151713 | A2 | 12/2009 |
| WO | WO2013104807 | A1 | 7/2013 |
| WO | WO2014184875 | A1 | 11/2014 |
| WO | WO2016181234 | A1 | 11/2016 |
| WO | WO2016187713 | A1 | 12/2016 |
| WO | WO2017031426 | A1 | 2/2017 |

OTHER PUBLICATIONS thefirearmblog.com [online], "Radetec AmmoControl Digital Counter and Led Advisor", published on Jan. 28, 2013, retrieved from URL <https://www.thefirearmblog.com/blog/2013/01/28/radetec-ammocontrol-digital-counter-and-led-advisor>, 4 pages.

youtube.com [online], "Bullet Counter 2.0", published on Mar. 24, 2011, retrieved from URL <https://www.youtube.com/watch?v=cnx9yT5py8E>, 3 pages.

youtube.com [online], "Full-Auto Nerf Rayven", published on Apr. 22, 2013, retrieved from URL <https://www.youtube.com/watch?v=441WL_NJOQ8>, 3 pages.

youtube.com [online], "Lage Manufacturing MAX-41A Real Aliens Pulse Rifle", published Jan. 26, 2014, retrieved from URL <https://www.youtube.com/watch?v=+XT90YzPlhVE>, 4 pages.

youtube.com [online], "Review: Aliens Ammo Counter! from Blasterparts—AKA the most Awesome accessory Ever!", uploaded by GriffinMods, published on Nov. 23, 2013, retrieved from URL <https://www.youtube.com/watch?n=N7U3xAo6obE>, 3 pages.

* cited by examiner

FIREARM INCLUDING ELECTRONIC COMPONENTS TO ENHANCE USER EXPERIENCE

CROSS-REFERENCE TO RELATED APPLICATION

This application is a continuation of U.S. patent application Ser. No. 17/217,828, entitled FIREARM INCLUDING ELECTRONIC COMPONENTS TO ENHANCE USER EXPERIENCE, filed Mar. 30, 2021, now U.S. Pat. No. 11,561,057, issued Jan. 24, 2023, which is a continuation of U.S. patent application Ser. No. 15/951,591, entitled FIREARM INCLUDING ELECTRONIC COMPONENTS TO ENHANCE USER EXPERIENCE, filed Apr. 12, 2018, now U.S. Pat. No. 10,962,314, issued Mar. 30, 2021, which claims the benefit of and priority to U.S. Provisional Application No. 62/484,471, entitled FIREARM INCLUDING ELECTRONIC COMPONENTS TO ENHANCE USER EXPERIENCE, filed Apr. 12, 2017, the contents of which are herein incorporated by reference in their entireties.

TECHNICAL FIELD

The present invention relates to firearms, and more particularly to firearms including laser sighting devices and other devices for enhancing user experience.

BACKGROUND

Firearms typically do not provide users with information regarding the state of the firearm, although some firearms include electronic components that are intended to improve user experiences. Such electronic components include, for example, locks, safety devices, memories for storing firing parameters, rounds counters, compasses, programmable triggers, keyboards for configuring the firearm, and liquid crystal displays for presenting information to the user. However, firearms including such electronic components are typically difficult to manufacture and/or cumbersome for the user. In some cases, such firearms would also require use of uncommon firing mechanisms.

SUMMARY

According to one embodiment of the present disclosure, a firearm includes: a barrel portion adapted to discharge ammunition; a slide movable relative to the barrel portion; a frame coupled to the barrel portion and movably coupled to the slide, the frame comprising a grip, the grip comprising: a magazine chamber adapted to detachably receive a magazine carrying a plurality of cartridges of ammunition; a rear surface adjacent the slide; at least one sensor carried by the grip, the at least one sensor adapted to sense a state of the magazine detachably received in the magazine chamber corresponding to a number of cartridges of ammunition remaining in the magazine, and the at least one sensor operable to send a signal corresponding to the number of cartridges of ammunition remaining in the magazine; and a display carried on the rear surface of the grip, the display comprising a plurality of illuminating devices, the display operatively coupled to the at least one sensor and operable to receive the signal corresponding to the number of cartridges of ammunition remaining in the magazine, and the display operable to visually present the number of cartridges of ammunition remaining in the magazine by illuminating at least one of the plurality of illuminating devices.

According to another embodiment of the present disclosure, a firearm includes: a barrel portion adapted to discharge ammunition; a frame coupled to the barrel portion, the frame comprising: a grip comprising a magazine chamber adapted to detachably receive a magazine carrying a plurality of cartridges of ammunition; a trigger guard coupled to the grip; at least one sensor carried by the grip, the at least one sensor adapted to sense a state of the magazine detachably received in the magazine chamber corresponding to a number of cartridges of ammunition remaining in the magazine, and the at least one sensor operable to send a signal corresponding to the number of cartridges of ammunition remaining in the magazine; a controller carried by the frame, the controller operatively coupled to the at least one sensor to receive the signal corresponding to the number of cartridges of ammunition remaining in the magazine; a display carried by the frame, the display operatively coupled to the controller to visually present the number of cartridges of ammunition remaining in the magazine; at least one of a laser gun sight and an illuminating device carried by the frame; and a flexible circuit carried by the trigger guard, the flexible circuit operatively coupling the controller to the at least one of the laser gun sight and the illuminating device.

According to another embodiment of the present disclosure, a firearm includes: a barrel portion adapted to discharge ammunition; a slide movable relative to the barrel portion; a frame coupled to the barrel portion and movably coupled to the slide, the frame comprising a grip, the grip comprising: a magazine chamber adapted to detachably receive a magazine carrying a plurality of cartridges of ammunition; a rear surface adjacent the slide; at least one sensor carried by the grip, the at least one sensor adapted to sense a state of the magazine detachably received in the magazine chamber corresponding to a number of cartridges of ammunition remaining in the magazine, and the at least one sensor operable to send a signal corresponding to the number of cartridges of ammunition remaining in the magazine; and a light pipe carried by the frame and exposed at a rear surface of the grip, the light pipe operatively coupled to the at least one sensor and operable to visually present the number of cartridges of ammunition remaining in the magazine.

While multiple embodiments are disclosed, still other embodiments will become apparent to those skilled in the art from the following detailed description, which shows and describes illustrative embodiments. Accordingly, the drawings and detailed description are to be regarded as illustrative in nature and not restrictive.

Figure 1:
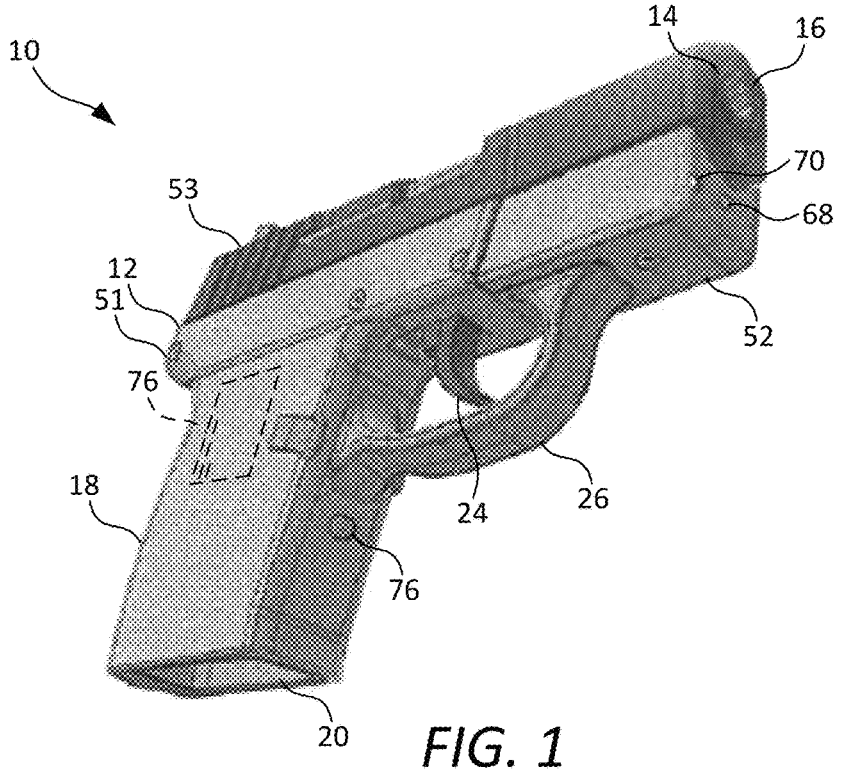
FIG. 1 is a perspective view of a firearm in accordance with an embodiment of the present disclosure.

While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives thereof.

DETAILED DESCRIPTION

Firearms in accordance with some embodiments of the present disclosure may provide a user with information regarding the state of the firearm, thereby enhancing the user's experience with the firearm. Such information may include measurement data, such as round counting and other statistical information regarding use of the firearm. In some embodiments, such information may be displayed without affecting the grip of the firearm.

Firearms in accordance with some embodiments of the present disclosure may integrally and internally carry electronic components that facilitate providing the user with information regarding the state of the firearm. Firearms in accordance with some embodiments of the present disclosure may integrally and internally carry auxiliary devices that are typically provided as "add-on" or accessory devices, such as laser sights, lights, and cameras. In some embodiments, incorporating such devices into a firearm provides various advantages, such as providing a more robust design, and reducing the size of a device that would otherwise be an accessory to a firearm. As a result, this may reduce issues associated with installation and maintenance of accessory devices. In addition, by integrating electronic components into the firearm, the user may seamlessly adapt to using the firearm rather than having an intrusive add-on accessory, which may be cumbersome for the user and for manufacturing. Further still, integrated electronic components may also facilitate fitting a firearm into a carrying device, such as a holster.

Figure 2:
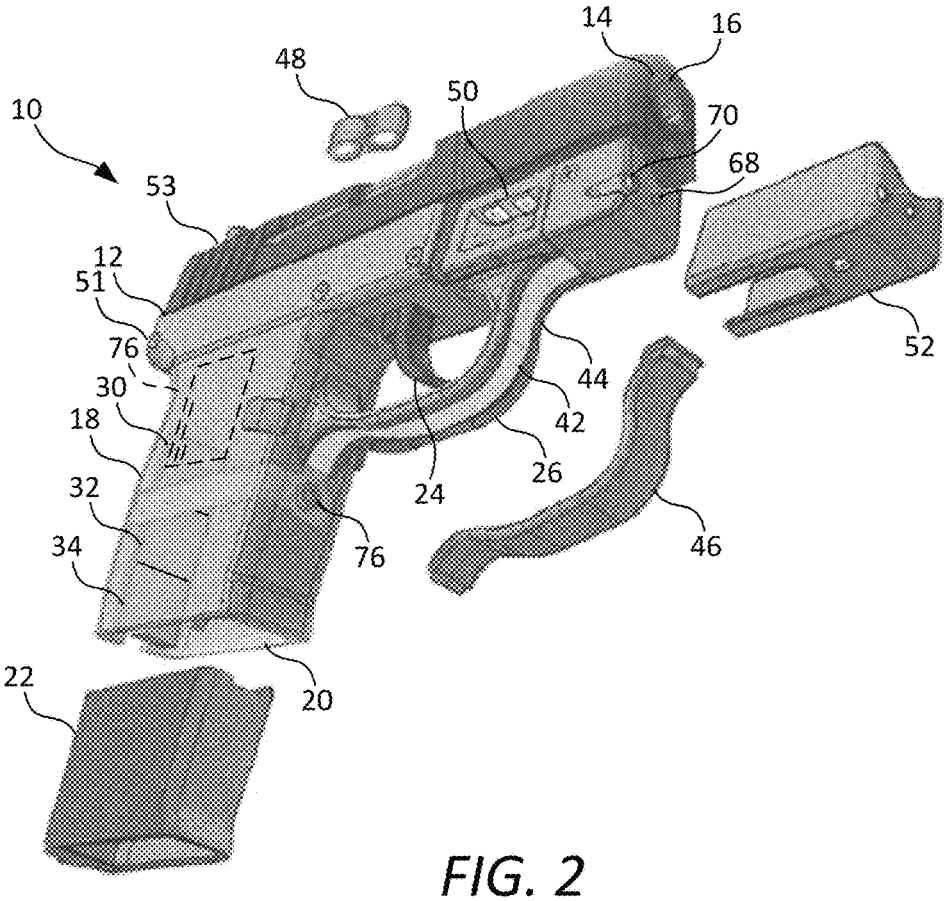
FIG. 2 is an exploded perspective view of the firearm of FIG. 1 and a magazine that may be detachably received by the firearm.

FIGS. 1 and 2 illustrate a firearm 10, more specifically, a handgun, in accordance with an embodiment of the present disclosure. Generally, the firearm 10 includes a frame 12 that couples to a barrel portion 14. The barrel portion 14 is adapted to discharge ammunition from a muzzle opening 16. The frame 12 includes a grip 18 that is grasped by the hand of firearm user. The grip 18 defines a magazine chamber 20, which may open at the bottom of the firearm 10, that detachably receives a magazine 22 carrying cartridges, or "rounds", of ammunition. In some embodiments, the firearm 10 is a blowback firearm or a recoil operation firearm (that is, the firearm 10 includes a slide 53 that moves backward relative to the frame 12 when the firearm 10 discharges ammunition). As described in further detail below, the firearm 10 further includes electronic components that facilitate providing the firearm user with information regarding the firearm 10, such as, for example, the number of cartridges of ammunition remaining in the magazine 22 carried by the firearm 10.

Figure 3:
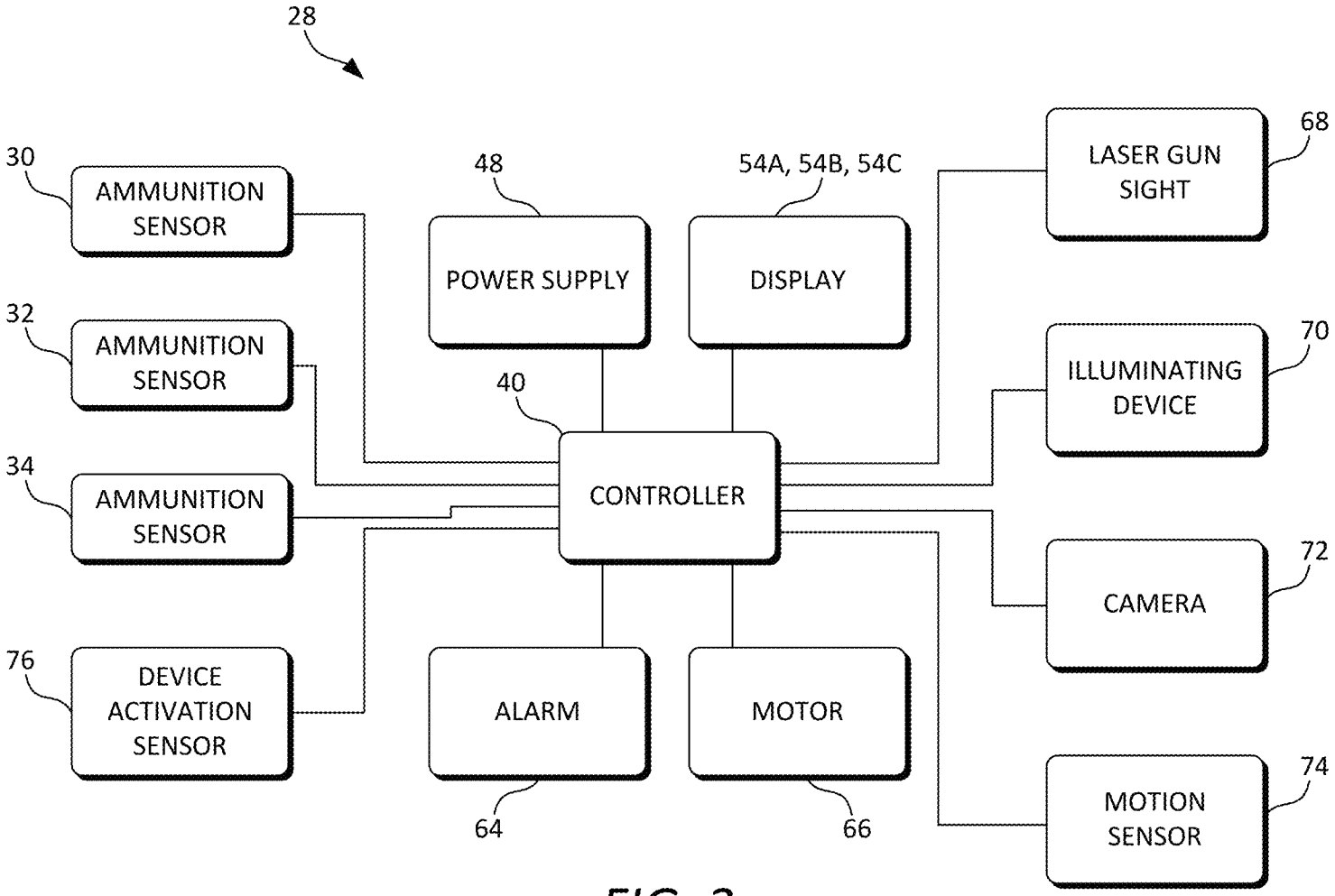
FIG. 3 is a schematic of an electronics assembly of the firearm of FIG. 1.
Figure 4:
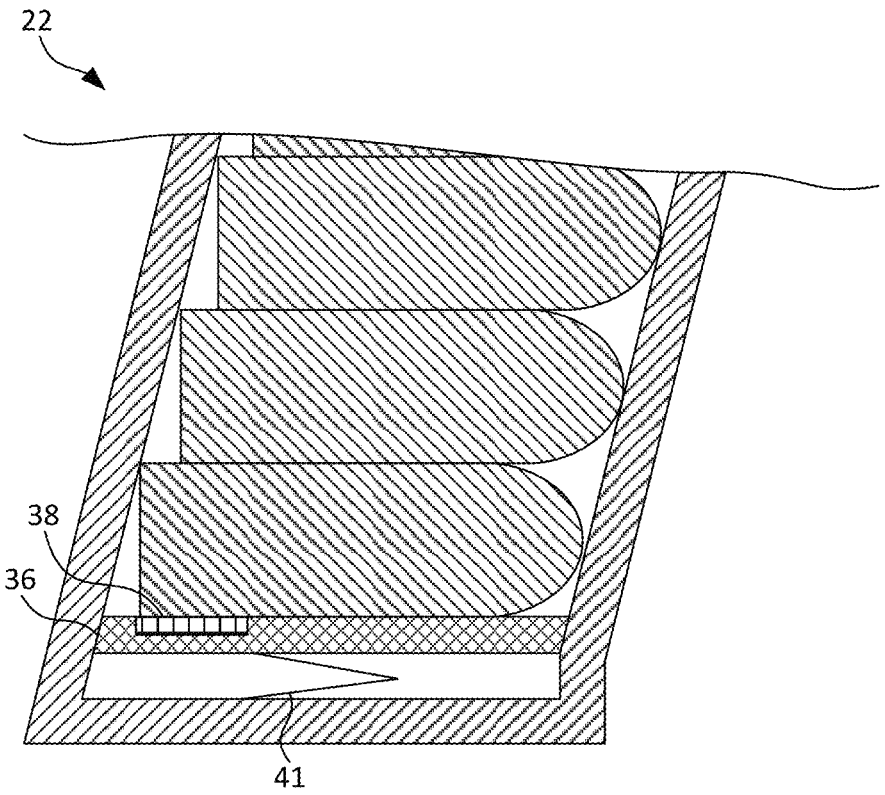
FIG. 4 is a side sectional view of the magazine of FIG. 2.

Still referring to FIGS. 1 and 2 and with additional reference to FIG. 3, the frame 12 of the handgun an electronics assembly 28 that facilitates providing the firearm user with information regarding the firearm 10. The electronics assembly 28 includes one or more sensors (for example, three sensors 30, 32, and 34 are depicted in FIG. 3) that are carried in the grip 18. The sensors 30, 32, and 34 are adapted to sense a state of the magazine 22 corresponding to a number of cartridges of ammunition remaining in the magazine 22, and the sensors 30, 32, and 34 send signals that correspond to the number of cartridges of ammunition remaining in the magazine 22. With additional reference to FIG. 4, the sensors 30, 32, and 34 may sense the state of the magazine 22 by sensing the position of the spring-biased ammunition ejection plate 36, or "follower," in the magazine 22. For a magazine 22 having a cartridge capacity N, the follower 36 occupies N+1 positions within the magazine 22 as the cartridges are ejected from the magazine 22. Similarly, when N cartridges remain in the magazine 22, the follower is disposed at the N+1 position within the magazine (for example, when zero cartridges remain in the magazine 22, the follower 36 is at a first position in the magazine 22, when one cartridge remains in the magazine 22, the follower 36 is at a second position in the magazine 22, and so forth). Thus, when the sensors 30, 32, and 34 send signals to indicate that the follower 36 is disposed at the N+1 position, the signals also indicate that N cartridges remain in the magazine 22.

In some embodiments, the number of sensors is equal to the number of positions that are occupied by the follower 36 within the magazine 22 (that is, N+1). In some embodiments, the number of sensors is less than the number of positions that are occupied by the follower 36 within the magazine 22. In some embodiments, the number of sensors is greater than the number of positions that are occupied by the follower 36 within the magazine 22.

In some embodiments, the sensors 30, 32, and 34 may be Hall effect sensors that sense the magnetic field produced by a magnet 38 carried by the follower 36 of the magazine 22. The magnet 38 may be a rare earth metal, and the magnet 38 may be carried in a pocket formed on the follower 36, adhered to a surface of the follower 36, and/or the like. In some embodiments and as shown in FIGS. 1-3, the grip 18 carries three Hall effect sensors 30, 32, and 34, and one sensor 34 is positioned near the opening of the magazine chamber 20, one sensor 30 is positioned near the top of the magazine chamber 20, and one sensor 32 is positioned at an intermediate position between the other sensors 30 and 34. Each sensor 30, 32, and 34 sends a signal that is proportional to the sensed force produced the magnetic field of the magnet 38, which is based on the position of the magnet 38 and the follower 36 within the magazine 22. As such, the signals change as the magnet 38 and the follower 36 are displaced within the magazine 22 to eject cartridges of ammunition into the barrel portion 14 of the firearm 10. As a result, the signals may be considered together to determine the number of cartridges of ammunition remaining in the magazine 22. Stated another way, the sensors 30, 32, and 34 may "triangulate" the position of the magnet 38 and the follower 36, and thereby the number of cartridges of ammunition remaining in the magazine 22 may be determined. In other embodiments, the grip 18 carries a single Hall effect sensor 34 near the opening of the magazine chamber 20. The sensor 34 sends a signal that is proportional to the sensed force produced the magnetic field of the magnet 38, which is based on the position of the magnet 38 and the follower 36 within the magazine 22. As such, the signal changes as the magnet 38 and the follower 36 are displaced within the magazine 22 to eject cartridges of ammunition into the barrel portion 14 of the firearm 10. As a result, the signals correspond to and may be used to determine the number of cartridges of ammunition remaining in the magazine 22.

In other embodiments, the sensors are a plurality of Reed switches that sense the magnetic field produced by the magnet 38 carried by the follower 36 of the magazine 22. The number of Reed switches may be equal to the number of cartridges of ammunition initially carried by the magazine, and movement of the follower 36 and the magnet 38 may actuate a different Reed switch each time a cartridge of ammunition is ejected from the magazine 22. As a result, the Reed switches together sense the relative position of the follower 36 and send signals that together correspond to the number of cartridges of ammunition remaining in the magazine 22.

In other embodiments, the sensors may be proximity sensors or optical sensors.

The sensors 30, 32, and 34 are operatively coupled to and send the signals corresponding to the number of cartridges of ammunition remaining in the magazine 22 to a controller 40, which may include a microprocessor. The controller 40 may be carried in the frame 12. In some embodiments, the controller 40 determines the number of cartridges of ammunition remaining in the magazine 22 based on the signals received from the sensors 30, 32, and 34 and by compensating for the changing density of the spring 41 in the magazine 22. That is, as cartridges of ammunition are ejected from the magazine 22 and the spring 41 unloads, the reduced metal density causes less interference between the magnet 38 and the sensors 30, 32, and 34. The controller 40 may be configured to consider the signals received from the sensors 30, 32, and 34 in view of this effect, and thereby compensate for this effect. In some embodiments, the controller 40 may be calibrated, for example, when a magazine 22 is coupled to the firearm 10, and thereby compensate for other factors that could affect the degree of interference between the magnet 38 and the sensors 30, 32, and 34, such as using magazines 22 formed of different materials and/or having different wall thicknesses, using magazines 22 carrying different types of cartridges, and the like.

In some embodiments and referring specifically to FIG. 2, the controller 40 may be carried in the frame 12 near the muzzle opening 16, and the sensors 30, 32, and 34 may be operatively coupled to the controller 40 via a flexible circuit 42 that extends from the grip 18, through the trigger guard 26, and toward the muzzle opening 16. The flexible circuit 42 may be disposed between a base portion 44 of the trigger guard 26 and a cover portion 46 of the trigger guard 26. In some embodiments and still referring specifically to FIG. 2, the controller 40 may be carried in the grip 18 of the frame 12, and the controller 40 may be operatively coupled to one or more components of the electronics assembly 28 carried in the frame 12 near the muzzle opening 16 (for example and as described in further detail below, a laser gun sight 68, an illuminating device 70, and/or a camera 72) via the flexible circuit 42. In any case, any of the remaining components of the electronics assembly 28 may be operatively coupled via the flexible circuit 42.

In some embodiments, a flat ribbon cable (not shown) may be used instead of a flexible circuit to couple two or more of the components of the electronics assembly in any of the manners described herein.

The electronics assembly 28 may include a power supply 48 carried by the frame 12. In some embodiments and referring specifically to FIG. 2, the power supply 48 may be carried in a cavity 50 of the frame 12 and normally obscured by a detachable front cover 52. The power supply 48 may be detachably carried in the frame 12 or non-detachably carried in the frame 12. The power supply 48 may be a rechargeable, non-rechargeable battery, or the like. The other components of the electronics supply may receive power from the power supply 48 via the controller 40.

Turning now to FIGS. 3, 5A, 5B, and 5C, the controller 40 is operatively coupled to and sends the signals corresponding to the number of cartridges of ammunition remaining in the magazine 22 to a display. The display visually presents the number of cartridges of ammunition remaining in the magazine 22. The display may be disposed at various locations on the firearm. For example and referring to FIGS. 1 and 2, the display may be disposed on the rear surface 51 of the grip 18 adjacent to the slide 53.

Figures 5A, 5B, 5C:
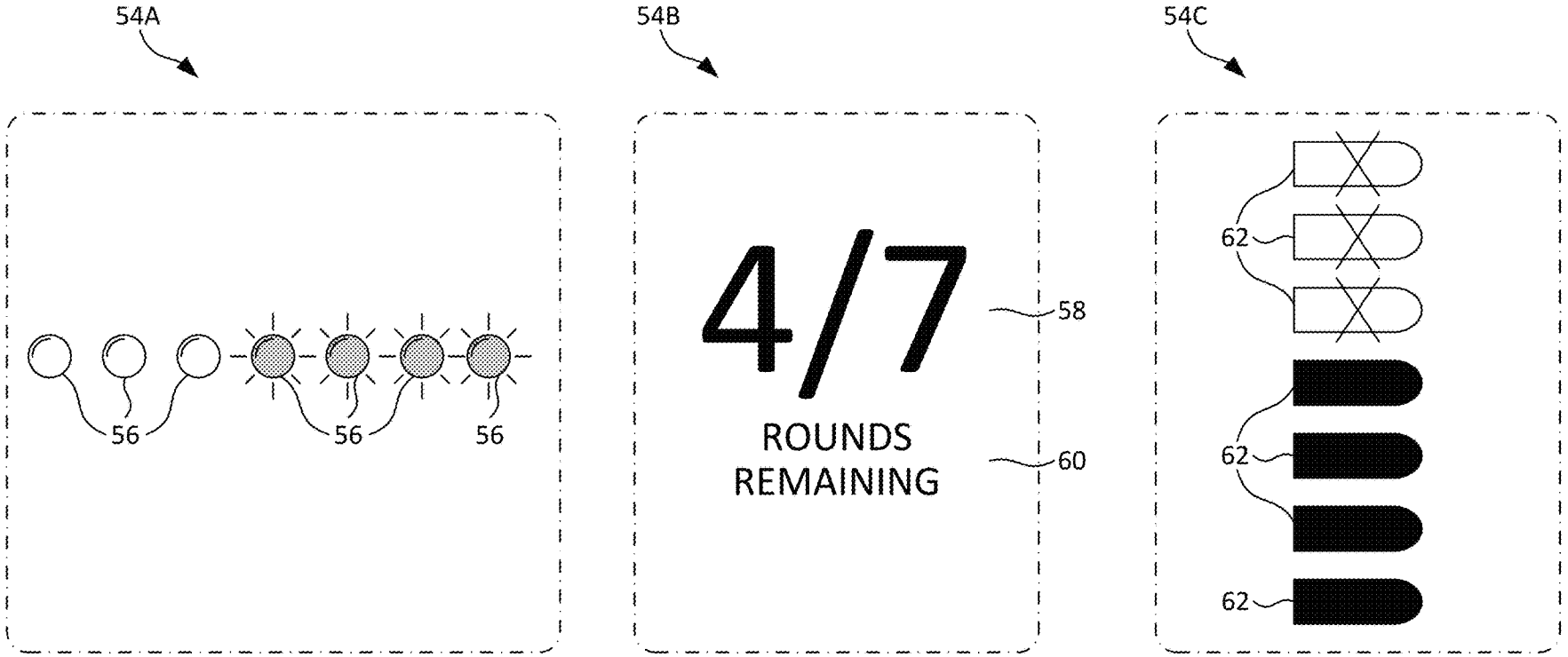
FIG. 5A is a detail view of a display of the firearm of FIG. 1 in accordance with an embodiment of the present disclosure.
FIG. 5B is a detail view of a display of the firearm of FIG. 1 in accordance with another embodiment of the present disclosure.
FIG. 5C is a detail view of a display of the firearm of FIG. 1 in accordance with yet another embodiment of the present disclosure.

The display may take various forms. For example and referring to FIG. 5A, a display 54A may include a plurality of illuminating devices 56 (for example, light-emitting diodes (LEDs)). In some embodiments and as shown in FIG. 5A, the plurality of illuminating devices 56 may be disposed in a horizontal array (that is, a row). In other embodiments, the plurality of illuminating devices 56 may be disposed in a vertical array (that is, a column).

In some embodiments, the controller may energize a number of illumination devices 56 corresponding to the number of cartridges of ammunition remaining in the magazine 22. In some embodiments, the controller also changes the color of the illumination devices 56 based on number of cartridges of ammunition remaining in the magazine 22. For example, the illumination devices 56 may emit green light when the magazine is relatively full (for example, having at least two thirds of its initial capacity), yellow light when the magazine is less full (for example, having at least one third and less than two thirds of its initial capacity), and red light when the magazine is relatively low (for example, having less than one third of its initial capacity). In some embodiments, the controller may energize a number of illuminating devices 56 based on a non-linear relationship with the number of cartridges of ammunition remaining in the magazine 22. For example, the controller may de-energize one illumination device 56 when one third of the cartridges of ammunition in the magazine 22 have been discharged, de-energize another illumination device 56 when another third of the cartridges of ammunition in the magazine 22 have been discharged, and then de-energize a single illumination device 56 when each of the remaining cartridges of ammunition in the magazine 22 have been discharged.

In some embodiments, the plurality of illuminating devices 56 are relatively light-weight and relatively small such that the presence of the display 54A does not significantly affect the mechanics of the firearm 10. In some embodiments, the plurality of illuminating devices 56 emit a relatively small amount of light compared to other types of displays (for example, liquid crystal display screens), which may be beneficial in dark and/or dangerous situations. In some embodiments, the plurality of illuminating devices 56 provides a relatively small and/or low power display compared to other types of displays (for example, liquid crystal display screens).

As another example, a display may be a screen (for example, a liquid crystal display screen) that presents characters (that is, numbers 58 and/or letters 60; see, for example, the display 54B of FIG. 5B) or symbols 62 (for example, shapes having the general appearance of cartridges of ammunition; see, for example, the display 54C of FIG. 5C) corresponding to the number of cartridges of ammunition remaining in the magazine 22. In some embodiments and as shown in FIGS. 5B and 5C, the characters (in the case of the display 54B of FIG. 5B) or symbols 62 (in the case of the display 54C of FIG. 5C) may also provide information regarding the initial capacity of the magazine 22. In other embodiments, the characters (in the case of the display 54B of FIG. 5B) or symbols 62 (in the case of the display 54C of FIG. 5C) may only provide information regarding the number of cartridges of ammunition remaining in the magazine 22. The display may provide information in color, grayscale, or black and white. The display may be carried at various locations of the frame 12. For example, the display may be carried at the rear of the frame 12.

In some embodiments, the firearm 10 may additionally provide an auditory warning (for example, via an alarm 64) and/or a haptic warning (for example, vibrating the firearm 10 by energizing a motor 66 having an eccentrically weighted shaft) based on the number of rounds remaining the magazine 22. For example, the firearm 10 may provide an auditory warning and/or a haptic warning if the magazine 22 has a "low" amount of ammunition remaining (for example, less than three rounds) or if the magazine 22 is empty. The alarm 64 and the motor 66 may be operatively coupled to the controller 40 and may receive power from the power supply 48 via the controller 40.

In some embodiments, the firearm 10 (more specifically, the controller 40 and, even more specifically, the display) does not require user programming and lacks components that facilitate user programming (for example, a user interface having inputs, such as a keyboard). In some embodiments, the firearm 10 automatically determines and displays the number of cartridges of ammunition remaining in the magazine 22.

Referring again to FIGS. 1-3, the controller 40 may be operatively coupled to and control one or more auxiliary devices, such as a laser gun sight 68 (for example, a green laser gun sight), an illuminating device 70 (for example, a light emitting diode), a camera 72 (for example, capable of capturing photo and/or video images), and/or a motion sensor 74 (which may be used, for example, as a training aid by monitoring steadiness of the firearm 10 prior pulling the trigger 24). The laser gun sight 68, the illuminating device 70, the camera 72, and/or the motion sensor 74 may be integrally and internally carried in the frame 12. The laser gun sight 68, the illuminating device 70, the camera 72, and/or the motion sensor 74 may be disposed at the front of the frame 12 proximate the muzzle opening 16 (see FIG. 2; the camera 72 is not shown in FIG. 2) to facilitate sighting, illuminating, and/or capturing images of a target. The laser gun sight 68, the illuminating device 70, the camera 72, and/or the motion sensor 74 may be exposed through openings in the front cover 52. In some embodiments, the laser gun sight 68 and/or the illuminating device 70 may be disposed at the top of the grip 18 to provide space in the front of the barrel portion 14 for the other auxiliary devices and to facilitate fitting the firearm 10 in storage or transport devices. The laser gun sight 68, the illuminating device 70, the camera 72, and/or the motion sensor 74 may receive power from the power supply 48 via the controller 40.

The controller 40 may activate any of the components of the electronics assembly 28, such as, for example, the sensors 30, 32, and 34, the display, the laser gun sight 68, the illuminating device 70, the camera 72, and/or the motion sensor 74 (simultaneously, according to a predetermined sequence, or according to a user-specified sequence) upon receiving a signal from an activation sensor 76. In some embodiments and as shown in FIGS. 1 and 2, the activation sensor 76 may be pressure switch, or pressure "pad", carried on the grip 18 below the trigger guard 26. In other embodiments, the activation sensor 76 may be pressure switch carried on a side surface of the grip 18. In any case, the sensor 76 may actuated, and the auxiliary devices are activated, when the firearm 10 is grasped by the grip 18. In other embodiments, the activation sensor 76 may sense when the firearm 10 has been removed from a firearm storage device (not shown), such as a holster. More specifically, the sensor 76 may be a Hall effect sensor or a Reed switch that senses the magnetic field produced by a magnet carried by the firearm storage device. The sensor 76 is actuated, and the auxiliary devices are activated, when the firearm 10 is removed from the firearm storage device and the sensor 76 does not sense the magnetic field produced by the magnet. In other embodiments, the sensor 76 may be a motion and/or position sensor (for example, an accelerometer) that senses when the firearm 10 is in a "holstered," or "vertical," position, when the firearm 10 is in a use, or "horizontal," position, or when the firearm 10 moves from a vertical position to a horizontal position. As such, the sensor 76 is actuated, and the auxiliary devices are activated, when the firearm 10 is in the horizontal position, or when the firearm 10 moves from the vertical position to the horizontal position. In some embodiments, the controller 40 may activate the laser gun sight 68, the illuminating device 70, the camera 72, and/or the motion sensor 74 upon receiving one or more signals from one or more other inputs, such as one or more actuatable buttons carried by the frame 12. In these embodiments, each input may be actuated to activate one of the auxiliary devices.

In some embodiments, the electronics assembly 28 does not control, and/or are electronically uncoupled from, the firing components of the firearm 10 (that is, the trigger 24, etc.).

Figure 6A:
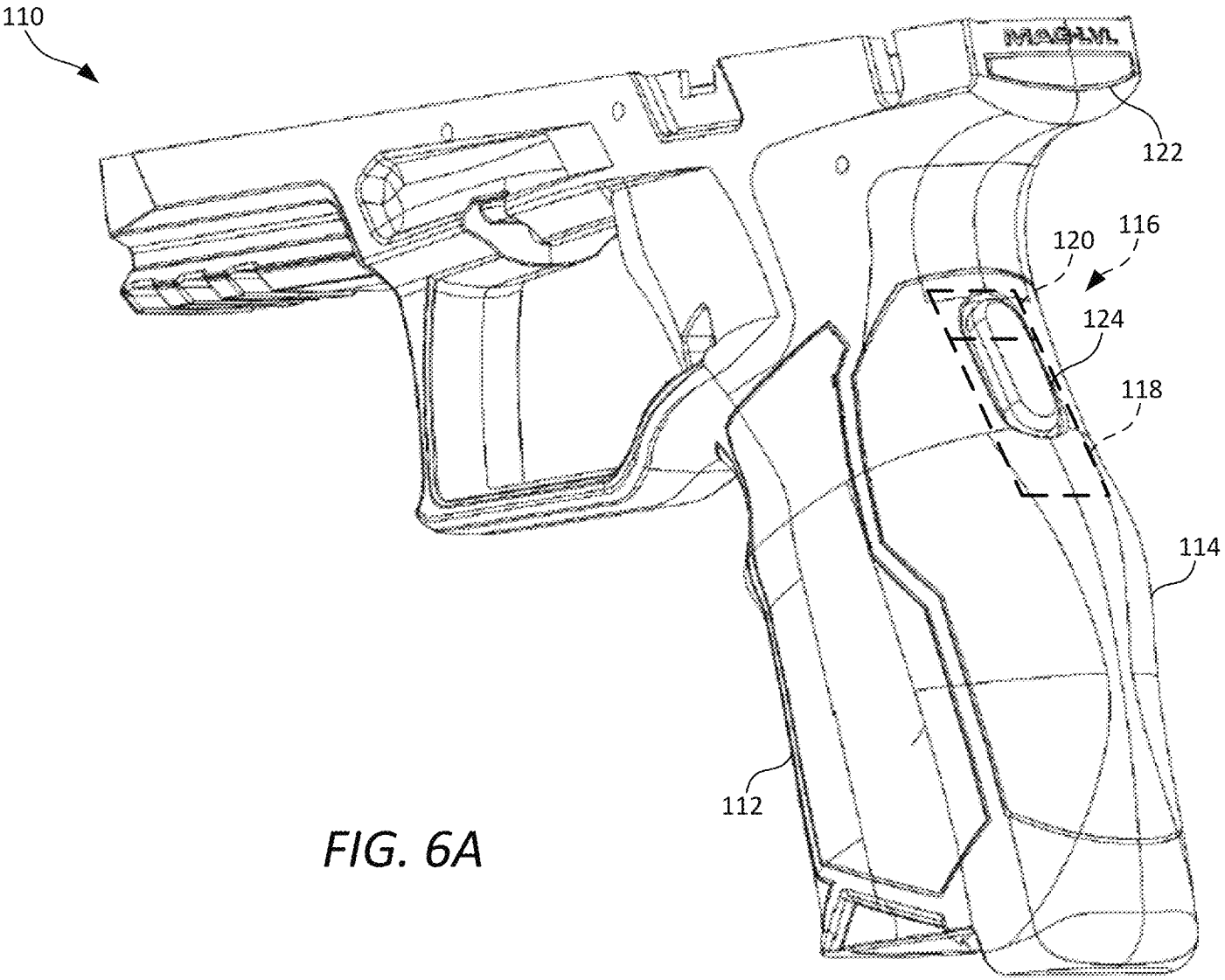
FIG. 6A is a partial perspective view of a firearm in accordance with another embodiment of the present disclosure.
Figure 6B:
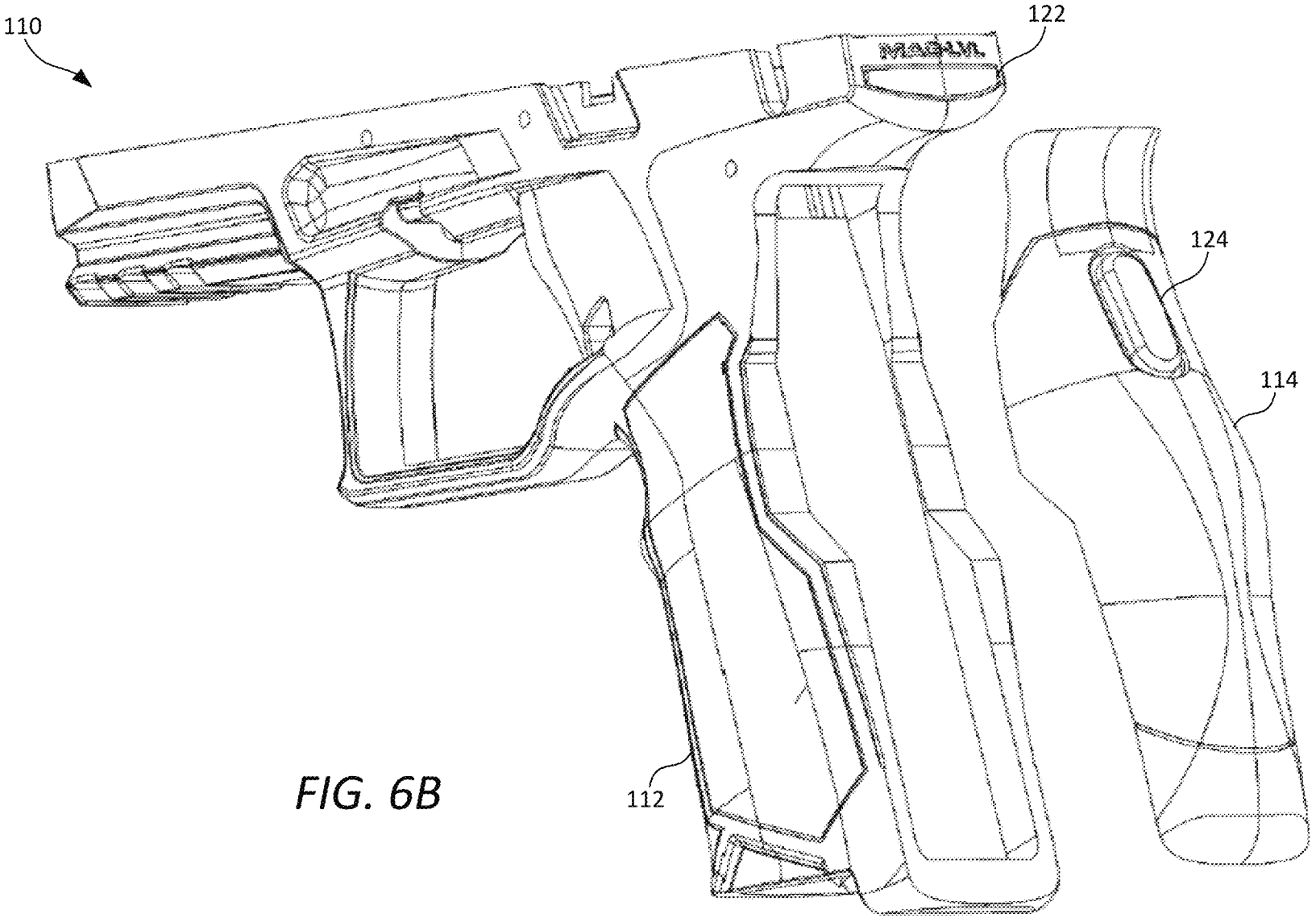
FIG. 6B is a partial exploded perspective view of the firearm of FIG. 6A.

FIGS. 6A and 6B illustrate a firearm 110, more specifically, a handgun, in accordance with another embodiment of the present disclosure. Generally, the firearm 110 includes the same components and features as the firearm 10, except that the firearm 110 includes a grip 112 having a selectively detachable rear portion 114. The detachable portion 114 may couple to the remainder of the grip 112 via, for example, fasteners (not shown), pins (not shown), or the like. The detachable portion 114 carries, in part, an electronics assembly 116, which may be generally similar to the electronics assembly 28 described above. The electronics assembly 116 includes a controller 118, such as the controller 40 described above, that is imbedded within or carried on an inner surface of the detachable portion 114 of the grip 112. The electronics assembly 116 also includes one or more sensors 120, such as the sensors 30, 32, and 34 described above, that are imbedded within or carried on an inner surface of the detachable portion 114 of the grip 112. The electronics assembly 116 further includes a light pipe 122 that couples to the controller 118 and the sensors 120. The light pipe 122 is exposed near the top of the rear surface of the grip 112 and acts as a display. That is, the light pipe 122 visually presents the number of cartridges of ammunition remaining in a magazine carried by the firearm 110. The light pipe 122 may visually present the remaining number of cartridges of ammunition in various manners, including, for example, by transmitting light from a plurality of illuminating devices, such as LEDs (and thereby having an external appearance similar to the display 54A described above). As another example, the light pipe 122 may visually present the remaining number of cartridges of ammunition by having an external appearance similar to the display 54B or the display 54C described above. The electronics assembly 116 further includes an input, illustratively an actuatable button 124, that is carried by the detachable portion 114 of the grip 112.

The button 124 may be actuated to activate the light pipe 122, a laser gun sight, such as the laser gun sight 68 described above, an illuminating device, such as the illuminating device 70 described above, a camera, such as the camera 72 described above, and/or a motion sensor, such as the motion sensor 74 described above.

Various modifications and additions can be made to the exemplary embodiments discussed. For example, while the embodiments described above refer to particular features, this disclosure also contemplates embodiments having different combinations of features and embodiments that do not include all of the described features. Accordingly, the scope of the disclosure is intended to embrace all such alternatives, modifications, and variations as fall within the scope of the disclosure, together with all equivalents thereof

What is claimed is:

1. A firearm comprising:

a barrel portion adapted to discharge ammunition;

a slide movable relative to the barrel portion;

a frame coupled to the barrel portion and movably coupled to the slide, the frame comprising a grip, the grip comprising:

a magazine chamber adapted to detachably receive a magazine carrying a plurality of cartridges of ammunition;

at least one sensor carried by the grip, the at least one sensor adapted to sense a state of the magazine detachably received in the magazine chamber corresponding to a number of cartridges of ammunition remaining in the magazine, and the at least one sensor operable to send a signal corresponding to the number of cartridges of ammunition remaining in the magazine; and a display carried by the frame, the display operatively coupled to the at least one sensor and operable to visually present the number of cartridges of ammunition remaining in the magazine.

2. The firearm of claim 1, wherein the grip further comprises a detachable portion, and the at least one sensor is carried by the detachable portion.

3. The firearm of claim 1, further comprising an activation sensor carried by the frame, the activation sensor being actuatable to send an activation signal to a controller, and the controller activating at least one of the display and the at least one sensor upon receiving the activation signal.

4. The firearm of claim 3, wherein the activation sensor is a pressure switch.

5. The firearm of claim 1, wherein the display is configured to provide a cumulative total of rounds fired over a period of time.

6. The firearm of claim 1, wherein the sensor is configured to be activated by recoil of the firearm.

* * * * *